US006244888B1

(12) United States Patent
Cappe

(10) Patent No.: US 6,244,888 B1
(45) Date of Patent: Jun. 12, 2001

(54) CONNECTOR WITH A PLUG AND BASE OF LOW INSERTION FORCE, PARTICULARLY OF THE TYPE WITH PIN/LYRE CONTACTS

(75) Inventor: Patrice Cappe, Faverolles (FR)

(73) Assignee: Framatome Connectors International, Courbevoie (FR)

( * ) Notice: Subject to any disclaimer, the term of this patent is extended or adjusted under 35 U.S.C. 154(b) by 0 days.

(21) Appl. No.: 09/378,889

(22) Filed: Aug. 23, 1999

(30) Foreign Application Priority Data

Aug. 24, 1998 (FR) ..... 98 10788

(51) Int. Cl.[7] ..... H01R 4/50
(52) U.S. Cl. ..... 439/341; 439/376
(58) Field of Search ..... 439/342, 341, 439/372, 326, 329, 376

(56) References Cited

U.S. PATENT DOCUMENTS

| | | | | |
|---|---|---|---|---|
| 3,656,086 | * | 4/1972 | Debaigt | 439/362 |
| 4,428,636 | | 1/1984 | Kam et al. | 339/97 |
| 4,718,859 | | 1/1988 | Gardner | 439/329 |
| 4,838,806 | * | 6/1989 | Igarashi | 439/341 |
| 4,941,837 | * | 7/1990 | Nakamura | 439/341 |
| 5,772,459 | | 6/1998 | Swart | 439/341 |

FOREIGN PATENT DOCUMENTS

| | | |
|---|---|---|
| 2351659 | 4/1974 | (DE) . |
| 0244192 A1 | 11/1987 | (EP) . |

* cited by examiner

*Primary Examiner*—Paula Bradley
*Assistant Examiner*—Tho D. Ta
(74) *Attorney, Agent, or Firm*—Perman & Green, LLP

(57) ABSTRACT

A low insertion force electrical connector comprising at least a plug and a base provided with a blind recess for receiving the plug. The base has pin contacts. The plug is connected to a bundle of electrical cables by means of electrical contacts. The base and the plug comprise conjugal means on the base and plug, which conjugal means include the base having a guide groove opening into a swing and lock hole formed in the base. The conjugal means permit a displacement in translation, with the plug in a first orientation, and when the plug is completely inserted at the end of the blind recess of the base a swinging displacement of the plug relative to the base, from the first to a second orientation, in which the plug is immobilized in translation by first locking means on the base and plug.

19 Claims, 4 Drawing Sheets

CONNECTOR WITH A PLUG AND BASE OF LOW INSERTION FORCE, PARTICULARLY OF THE TYPE WITH PIN/LYRE CONTACTS

BACKGROUND OF THE INVENTION

The present invention relates to the field of electrical connectors of so-called low force of insertion, or zero force of insertion, more particularly with pin/lyre contacts.

To connect a layer of flexible cables to a rigid support of the printed card type, users require connectors needing a minimum insertion and blocking force, this latter remaining a necessity to permit any inadvertent disconnection. More generally, connectors are sought which will permit avoiding any accidental disconnection.

There is known for example a connector of zero insertion force described in U.S. Pat. No. 4,718,859, provided to receive a layer of cables.

Such a connector comprises two blocks:

- a fixed block, generally connected to a support and provided for this purpose with blade contacts with a plug which are welded to the support, and
- a movable block which coacts with the fixed block to immobilize the cables of the layer and ensuring contact between the cables of this layer and the blades, this requiring no insertion effort of the layer.

The movable block is mounted on the fixed block by translatory movement, guide means ensuring a suitable positioning of the two parts. The layer is then inserted between the two blocks. It then suffices to pivot the movable block relative to the fixed block to ensure pressing one portion of the blades against the cables, thereby ensuring the electrical connection. The locking is simultaneously ensured because any displacement in translation of the movable block relative to the fixed block is prevented.

The problem solved by this patent is that of the variations of thickness of the various layers to be inserted in this connector. Thus, these variations give rise to loss of pressure force of the plugs of the fixed block on the cables of the layer, unless different models are provided, each applicable to a type of layer. Given the very low sales price of these connectors, it would be of interest to provide a connector permitting receiving different thicknesses of layers of cables.

To solve this problem about different thicknesses, the base as specified in this American Patent have blades with a particular C-shaped profile, with offset ends thus forming two offset contact points, above and below the layer. Branches of the C shaped profile have a sufficient flexibility and adjust to thickness variations. The layer presents an S-shaped deformation when it is thin and the layer remains substantially flat when it is thick. The contact pressure is obtained in the same manner in both cases and only a contact at two points is possible.

SUMMARY OF THE INVENTION

The present invention provides a connector comprising a base and a plug, which requires very low insertion and locking force of the plug and the base, which gives rise to excellent electrical connection, which comprises first and if desired second blocking means, which is simple to produce, and which is easy to manipulate.

To this end, according to the invention, the electrical connector of low insertion force, comprises a base provided with a blind recess provided to receive a plug, this base carrying connection pins and this plug being connected to a bundle of electrical cables, and is characterized in that it is provided with translatory guide means, particularly comprising at least one guide ramp opening into a locking hole, which hole constitutes the first locking means so-called in translation, by coacting with at least one fixed rib of a suitable profile to assume a first orientation in which it can be moved in translation along said ramp and a second orientation in which it is immobilized in the locking hole by swinging relative to the plug and the base.

This electrical connector also comprises second locking means so-called in swinging.

According to a particular arrangement, the rib of the plug has a width equal to the width of the ramp of the base and its longitudinal axis is inclined relative to the plane of the lower and upper surfaces of the plug by an angle $\alpha$, such that the base and the plug are aligned after locking.

According to the preferred embodiment, the second locking means comprise a ring mounted slidably on the upper end of the block of the plug and provided with two lateral tongues of a shape and position suitable to penetrate each one into the groove of the corresponding ramp. There are moreover provided retaining means for this ring in the active and inactive positions.

According to a particular application of the invention, each electrical contact of the plug is a blade contact of the lyre type with two branches provided to come into contact on opposite sides of each pin carried by the base.

According to some others features of the invention, particular dispositions of contacts of the connector are mentioned which allow the reinforcement of the electrical connection and make the cables installation easier while certifying the quality of such installations.

BRIEF DESCRIPTION OF THE DRAWINGS

The present invention will now be described with respect to the accompanying drawings in which the different figures show.

DETAILED DESCRIPTION OF THE INVENTION

Figure 1A:
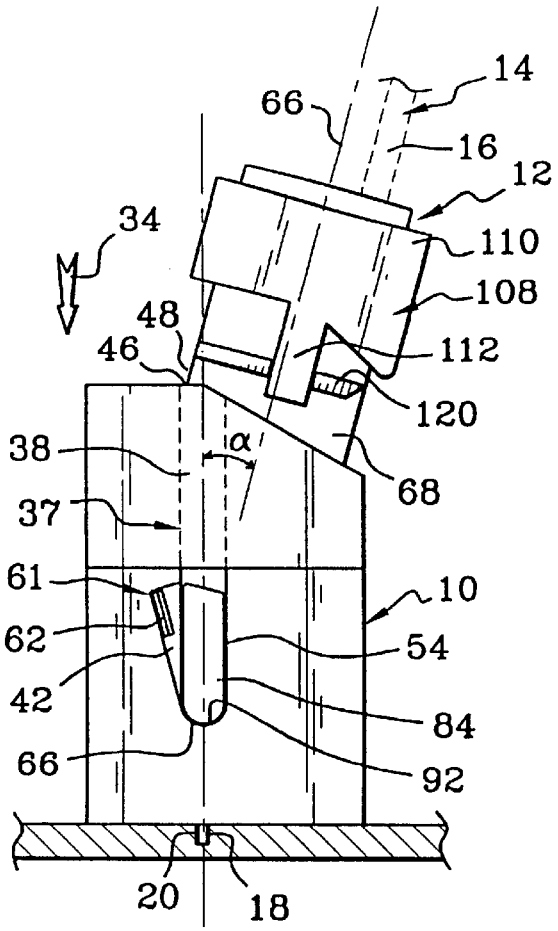
FIGS. 1A and 1B a side elevational view of a connector according to the invention in a first position before locking and a second position after locking, FIG. 2, a cross-sectional view in a transverse plane along the line 2—2, FIG. 3, a cross-sectional view in a transverse plane along the line 3—3, FIGS. 4A and 4B, views of the upper and lower surfaces of the plug of the connector according to the invention, and FIGS. 5A, 5B and 5C, a sequence of emplacement of the plug in the base of the connector according to the invention, partially broken away so as to show the connecting pins and blades.

In FIG. 1, there is shown a base 10 and a plug 12 in the insertion position. The plug is provided to receive a bundle 14 of electrical cables 16 disposed in a layer for example whilst the base comprises emergent pins 18, positioned in the course of molding said base.

The pins generally have in known manner a connection tail 20 to a printed circuit in the case in which the invention relates to a device for plug/base connection to a printed circuit or, again in a known manner, an attachment region for an electric wire when the connection device relates to a male/female connector.

The base 10 comprises a blind recess 22 for reception of the plug.

Figure 1B:
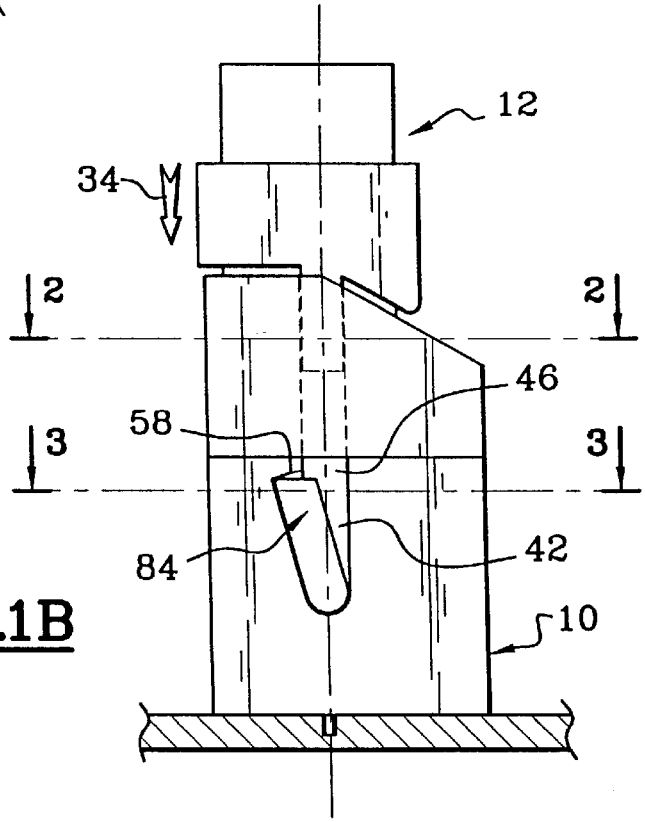
Figure 2:
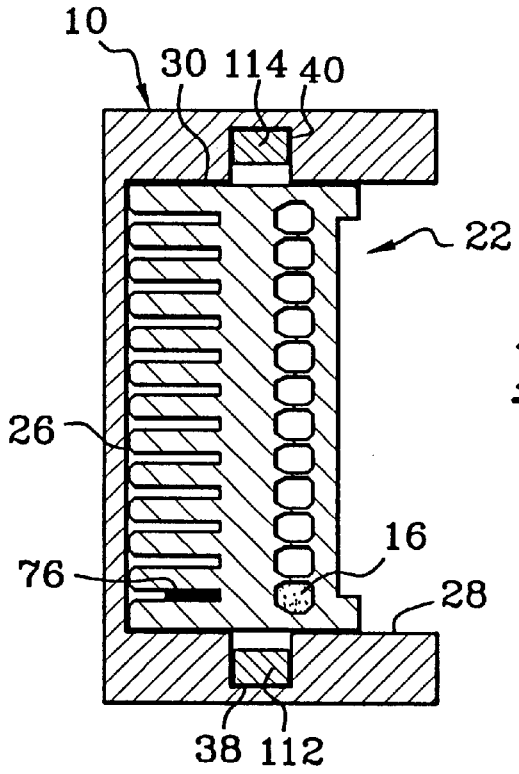
Figure 3:
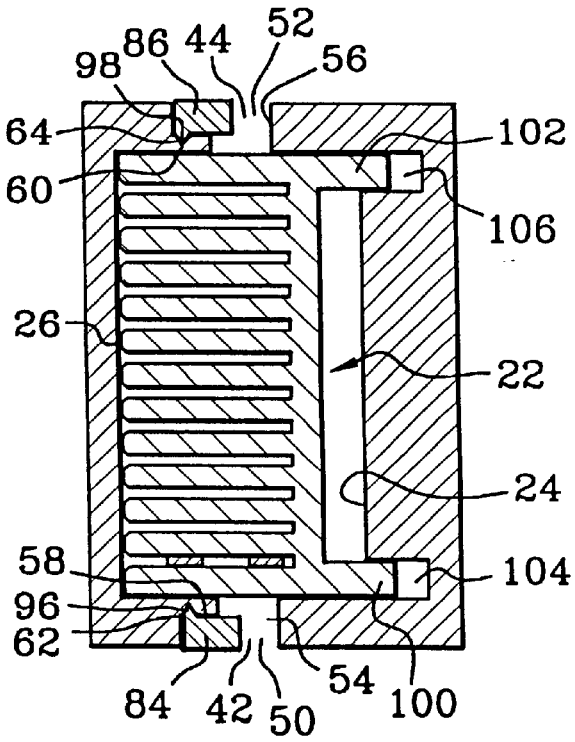
Figure 4A:
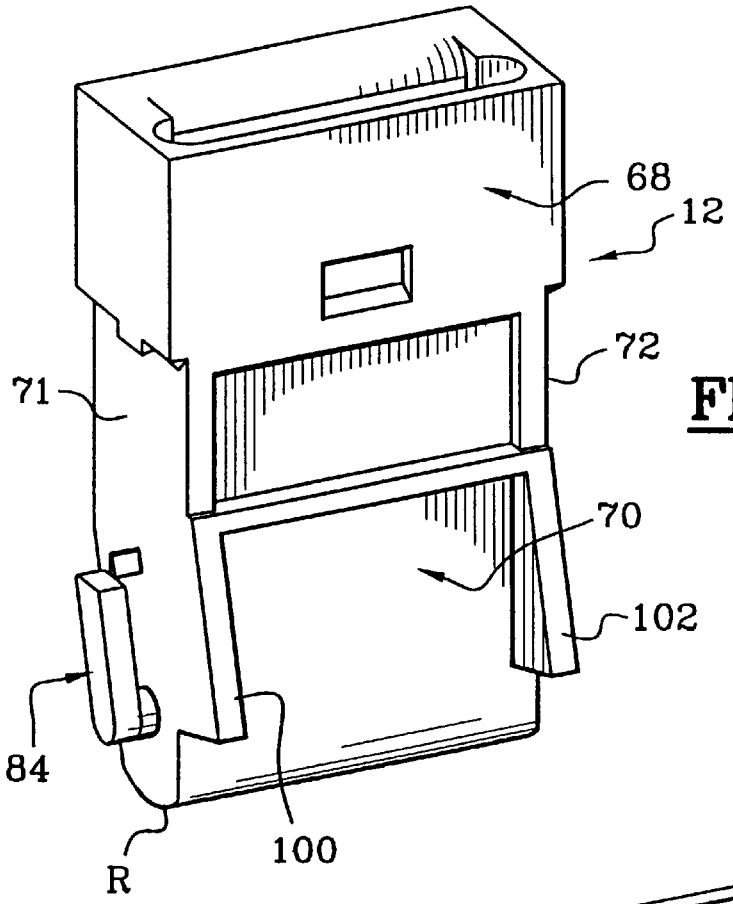
Figure 4B:
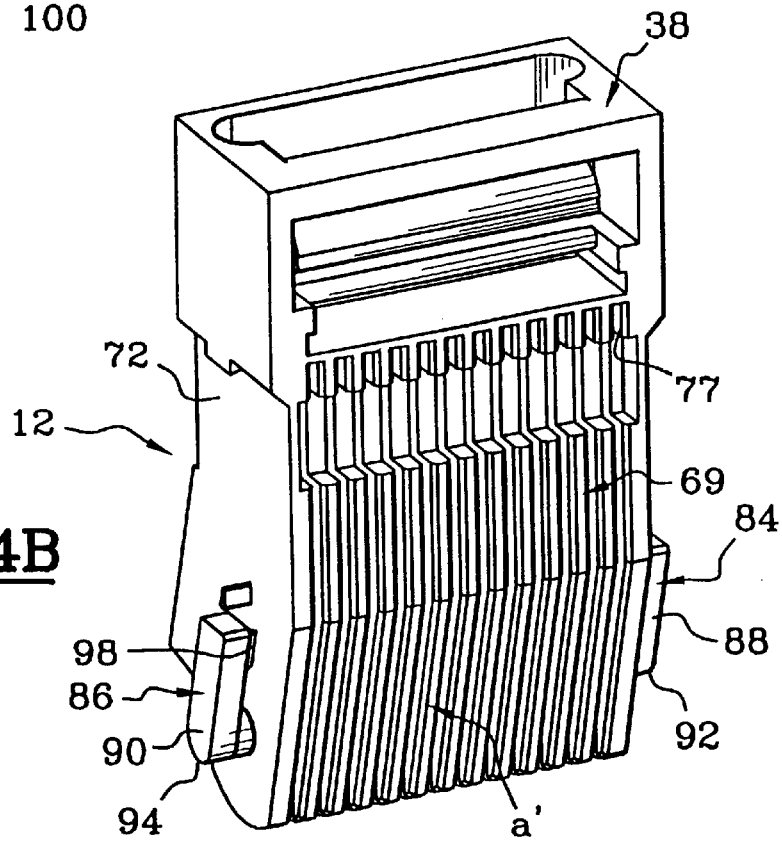

This recess 22 comprises:

a plugging wall 24, a bearing wall 26, opposite the plugging wall, two side guide walls 28 and 30, only the wall 28 being seen in FIGS. 1A and 1B, the other wall facing it and being visible in FIGS. 2 and 3, and a bottom 32, slightly curved over a radius R.

The plugging wall 24 is inclined at an angle α, of the order of 10 to 20°, relative to the direction of introduction of the plug 12, shown by the arrow 34. Moreover, this plugging wall comprises a series of two canted surfaces p and q, shown in FIGS. 5A, 5B and 5C.

The bearing wall 26 is substantially parallel to the direction of introduction. It comprises a series of three canted walls a, b and c.

Each of the lateral walls 28 and 30 is provided with first guide and locking means 37, comprising two guide ramps or grooves 38, 40 (see FIG. 2) each in the form of a groove disposed in the plane of the wall and with two holes or swing and lock holes 42, 44 for evident reasons of symmetry and stability. One 46, 48 of the ends of each of the ramps emerges from the edge of the blind recess 22 whilst the other 50, 52 of the ends emerges downwardly into the corresponding hole 42, 44.

The holes 42, 44 have a particular shape, substantially in the form of a right triangle. Each large side 54 and 56 of the right triangle is aligned with the edge of each corresponding ramp 38, 40, on the side of the plugging wall 24.

Each small side 58, 60 is of a length greater than the width of the corresponding groove constituting each ramp. Adjacent to each small side, on the side surface 28, 30 at the outside, there is provided first locking means 61 in swinging, comprising a blocking notch 62, 64 as a depression.

The lower angle 66 of each of the holes which serves for a bearing, is provided with a hollow of a radius r.

The plug 12 comprises a block 68 of a shape partially conjugated to that of the blind recess 22 of the base with two upper and lower surfaces 69 and 70 substantially parallel and two later guide surfaces 71, 72. This block comprises two surfaces a' and b' on the upper surface and a single surface p' on the lower surface.

In known manner, this block 68 comprises a slot 73 for reception of a bundle 14 of electrical cables 16. The conductive portion of each cable is prolonged in the juxtaposed sockets 74. Each socket is provided with a hole 75 for passage of an electrical contact 76 in the form of a blade, each comprising a foot 78 and a head 80. These electrical contacts with a profile of the lyre type are maintained in recesses 77 provided in said block, providing a comb and reaching around these blades with a profile of the lyre type, wrapping them laterally at least. This disposition insure to maintain a regular gap between blades, to maintain them rigid to have a good connection with the pins and to insulate them electrically speaking while keeping the possibility for pins to penetrate to insure electrical connection.

Each contact 76 can have two positions, one, before mounting, in which the foot 78 of the contact is outside the socket and the other, after mounting, in which the foot 78 of the contact projects into the socket 74 to penetrate into the conductive portion of the corresponding cable and to ensure the electrical connection. The foot is generally provided with barbs which prevent the retraction of each blade contact outside its recess after mounting.

In this embodiment, the head 80 of each contact 76 is in the shape of a lyre 82, with two branches 82-1 and 82-2.

Figure 5C:
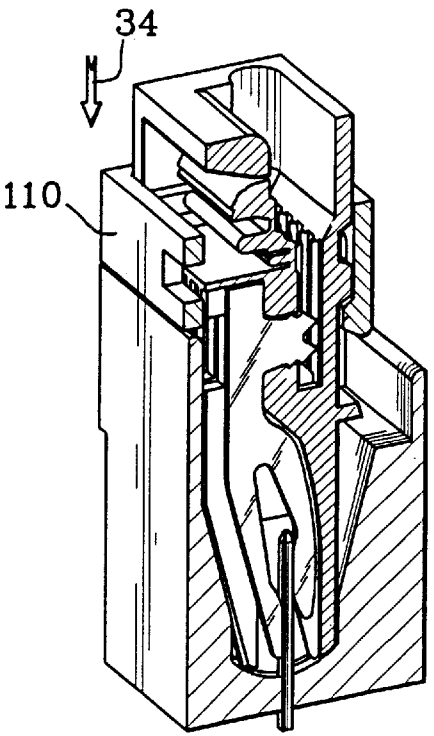
Figure 5B:
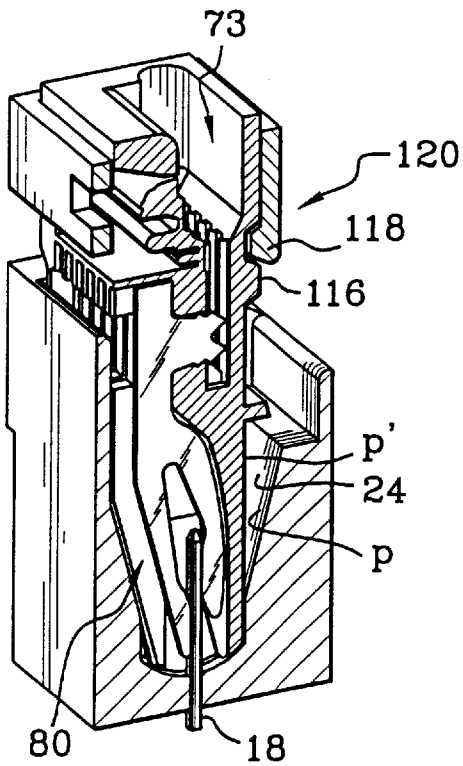
Figure 5A:
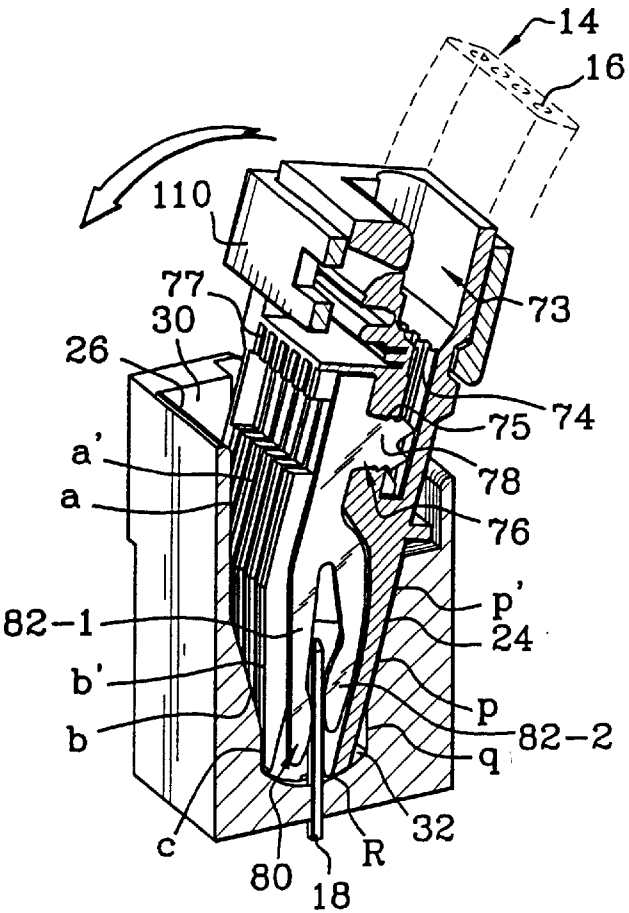

Each of these branches has a particular profile of the lyre type which permits, as shown in FIG. 5A, a contactless introduction between the pin and the branches with a profile of the lyre type before swinging and a substantial contact at many points after swinging, as shown in FIGS. 5B and 5C.

The plug also has a portion of the first guide and locking means in the form of two ribs 84, 86. Each rib comprises a rectilinear portion 88, 90 of a width equal to the width of the ramps of the base, with a sliding play similar to and a length equal at most to that of the greatest side 54, 56 of the hole 42, 44. One of the ends 92, 94 of each rib is rounded with a radius of curvature equal to r to coact with the hollow 66 provided in the lower portion of the hole.

Each rib is provided with a boss 96, 98 provided to coact with notches 62, 64 provided in the base as will be explained later.

So as to take account of the remaining thickness of each side wall, the rib is spaced from the side wall which carries it.

Moreover, the longitudinal axis of the rib also forms an angle α with the longitudinal axis 66 of the block 68 whose four surfaces are substantially parallel two by two if the canted surfaces are excluded. As to the end of the block, it is slightly rounded with a radius R identical to the radius R of the bottom 32.

The base and the plug are also provided with second guide means 70, in this case two wings 100, 102 carried by the plug and two grooves 104, 106 provided in the base and of a complementary profile to permit precise positioning. It is thus desirable to limit the play of penetration such that the blade contact of the lyre type will occupy a position, by its two branches 82-1 and 82-2, on opposite sides of the corresponding pin 18.

The connector according to the present invention can also be completed by second locking means 108.

These second locking means comprise a ring 110 mounted slidably on the upper end of the plug, which end remains outside the base after plugging in.

This ring comprises two lateral tongues 112, 114 of a shape and position adapted to penetrate each one into the corresponding groove of the ramp 38, 40.

This ring can have two positions, one shown in FIG. 1A in which the ring is in the upper inactive position and the other shown in FIG. 1B in which the ring is in the lower active position, for swinging locking, the tongues 112, 114 entering into the ramps in the direction of the arrows.

According to the preferred embodiment, there is also provided means 120 for retaining the second locking means in each of the active and inactive positions, comprising a double boss 116, 118 provided within the ring, and outside of the plug, the assembly forming a hard point.

The emplacement of such a connector is carried out as will be explained.

The base is considered as stationary in the present case, the pins 18 projecting into the blind recess 22.

The plug 12 is inserted into the blind recess and in the first step, the plug is guided in vertical translation by the ribs 84, 86 which slide along the ramps 38 and 40. The block 68 of the plug is in the inclined position.

Upon introduction of the block, each electrical contact 76 of the blade lyre type comes onto opposite sides of the associated pin with its branches 82-1 and 82-2, but without contact with the pin.

The wings 100 and 102 of the plug complete guidance by coaction with the grooves 104 and 106 of the base.

When the plug is entirely inserted into the base with the end of the block against the bottom 32, the block bears with a portion of its surface b' against the surface c of the base and with its surface p' against the surface p of the plugging surface.

Each rib 84, 86 is then in line with the hole 42, 44.

To obtain final mounting, the block 68 of the plug is manipulated by swinging in the direction of the arrow of FIG. 5A, which is to say such that the longitudinal axis 66 of the block coincides with the longitudinal axis of the base, the angle α becoming zero.

The boss 96, 98 of each rib snap connects with the corresponding notch 62, 64 of the lateral surface 28, 30 of the base. This snap connection, by its resilience, permits the operator to sense the maneuver and to see that the locking point has been reached.

Each electrical contact 76 comes into contact with its branches with the corresponding pin 18 as shown in FIGS. 5B and 5C.

The block 68 is then located in abutment by its surfaces a' and b' of its upper surface against the surfaces a and b of the base, which provides a stable bearing, the more so that the rear surface bears with its surface p' against the surface q of the base.

The first locking means prevents the retraction of the plug from the base. Nevertheless, the plug can be brought into inclined position by reverse swinging, providing a reduced force to pass the hard point constituted by the boss/notch couples, these couples ensuring breaking of undesired swinging, particularly arising from vibrations or light shocks.

It is also useful to provide the present connector with second locking means 108 which prevent this return swinging movement. It suffices to manipulate the sliding ring 110 from the upper end of the plug toward the base, in the direction of the arrow 34 of introduction of the plug into the base.

Each tongue 112, 114 then penetrates the corresponding ramp 38, 40 as is visible in FIG. 1B and the cross-sectional view of FIG. 2.

It will be noted that the plug is nevertheless removable by successive performance of the reverse steps. On the contrary, any undesired disconnection is prevented without deliberate intervention.

The snap-in system could be modified with a boss/notch couple disposed between the rib and the facing slide surface by a rib as described above by replacing it with a boss or a notch at any point along the rib from the moment at which a notch or a conjugated boss come face to face in the base.

What is claimed is:

1. A low insertion force electrical connector comprising at least a base provided with a blind recess, and a plug sized and shaped to be received in the recess, this base having pin contacts, and this plug being connected to a bundle of electrical cables by means of electrical contacts, characterized in that the base and the plug comprise conjugal means on the base and plug for guidingly translating the plug into the base and for locking the plug in the base, a portion of the conjugal means on the base including a guide groove formed in the base, said groove opening into a swing and lock hole of the base, wherein when the plug is inserted into the blind recess of the base, the conjugal means on the base and plug are aligned to each other to permit displacement in translation of the plug into the recess with the plug in a first orientation relative to the base, and when a portion of the conjugal means on the plug exit the guide groove into the swing and lock, hole the conjugal means on the base and plug permit a swinging displacement of the plug relative to the base from the first orientation to a second orientation, in which the conjugal means on the base and plug are misaligned so that the plug is immobilized in translation in the base by first translation locking means formed by said misalignment.

2. Electrical connector according to claim 1, characterized in that the portion of the conjugal means of the plug comprise at least one fixed rib depending from the plug and having a profile allowing the rib to be conjugally received in the guide groove and to be displaced in transaction within said guide groove in the base with the rib being in a first orientation relative to the groove and the rib profile further being adapted for the rib to be swung when the rib is in the swing and lock hole from the first orientation to a second orientation of the rib with respect to the groove by swinging of the plug relative to the base.

3. Electrical connector according to claim 2 characterized in that said rib of the plug has a width equal to a width of the guide groove of the base and in that a longitudinal axis of the rib is inclined relative to the lower and upper surfaces of the plug by an angle (α), such that the base and the plug are aligned with each other after locking the plug and base with the first translation locking means.

4. Electrical connector according to claim 2 characterized in that:

the blind recess of the base comprises a plugging wall, a bearing wall facing the plugging wall two side guide and locking walls, the guide groove and swing and lock hole being disposed in one of the sidewalls, the other sidewall having another guide groove and swing and lock hole defined therein;

the plugging wall making an angle (α) with the bearing wall, the plug comprises a block with an upper surface and a lower surface, the upper and lower surfaces being substantially parallel at least in part and provided to coact with the plugging and bearing walls, and the plug comprises two lateral surfaces each adapted to carry said rib.

5. Electrical connector according to claim 4, characterized in that the base comprises first rotation locking means cooperating with said rib to prevent swinging of said plug relative to the base when the plug is in the second orientation and the first rotation locking means are engaged by said rib.

6. Electrical connector according to claim 5, characterized in that the rib is disposed outside from one of the side walls of the block facing the rib, the rib having a boss to engage a notch provided on the outside of the side wall, the boss and notch constituting said first rotation locking means.

7. Electrical connector according to claim 5, characterized in that the connector further comprises second rotation locking means for preventing swinging of said plug relative to said base when the plug is in the second orientation and the second rotation locking means are engaged.

8. Electrical connector according to claim 7, characterized in that the second rotation locking means comprise a ring mounted slidably along an upper end of the block and said ring is provided with two lateral tongues of a shape and position such that each can penetrate into the guide groove in each corresponding sidewalls of the base.

9. Electrical connector according to claim 8, characterized in that the ring and the plug comprise means for retaining the ring in active and inactive positions, in the form of a double boss.

10. A low insertion force electrical connector, comprising a base provided with a blind recess having pin contacts therein, and a plug adapted to be received in the blind recess the plug having electrical contacts connected to a bundle of electrical cables, characterized in that each electrical contact is a blade contact having a general lyre shape with two branches provided to come into contact on opposite sides of a corresponding one of the pin contacts of the base when the plug is received in the blind recess of the base, the lyre shaped electrical contact being sized and shaped to permit substantially contactless insertion of the corresponding pin contact between the two branches of the electrical contact when the plug is received in the blind recess.

11. Electrical connector with a low insertion force according to claim 10, characterized in that when the plug is received in the base, the two branches of each electrical contact are brought into contact with the corresponding pin contact between the two branches by swinging the plug relative to the base from one orientation to another, the two branches each being substantially contactless with the corresponding pin contact before swinging and having substantial contact at many points with the corresponding pin contact after swinging.

12. Electrical connector with a low insertion force according to claim 10, characterized in that each electrical contact comprises a foot and a head.

13. Electrical connector with a low insertion force according to claim 12, characterized in that the plug comprises a block equipped with a slot for reception of the bundle of electrical cables.

14. Electrical connector with a low insertion force according to claim 12, characterized in that the electrical contacts are maintained in recesses defining a general comb shape in said block, which each recess having an opening extending around a portion of the electrical contact in each recess, which portion has the lyre shape.

15. Electrical connector with a low insertion force according to claim 13, characterized in that the block comprises juxtaposed sockets, adapted for reception a conductive portion of each cable.

16. Electrical connector with a low insertion force according to claim 15, characterized in that each socket comprises a hole through which the foot of each electrical contact is inserted, said foot having two positions, one waiting position, in which the foot is outside the socket, before mounting the electrical cables and another position, in which the foot projects into the socket to penetrate into the conductive portion of each corresponding electrical cable and to ensure an electrical connection between the electrical contact and cable.

17. A low insertion force electrical connector comprising:

a base section having a recess therein with pin contacts; and a plug adapted to be inserted into the recess of the base section, the plug having electrical contacts connected to the pin contacts when the plug is inserted into the base section;

wherein the base section includes means for guiding the plug into the base section with a low insertion force when the plug is inserted into the base section, and means for pivoting the plug relative to the base section after the plug is inserted into the base section, insertion of the plug into the base section being permitted by the means for guiding the plug when the plug is disposed in a first orientation relative to the base section, the means for pivoting the plug permitting pivoting of the plug relative to the base section from the first orientation in which the plug is inserted to a second orientation;

and wherein the plug has a first locking means for locking the plug and base section, a second locking means for locking the plug and base section, a third locking means for locking the plug and base section, and a fourth locking means for locking the plug and base section, the first, second, third, and fourth locking means each being engaged to lock the plug and base section when the plug is in the second orientation, wherein the first and third locking means each operate to prevent withdrawal of the plug from the base section, and the second and fourth locking means each operate to prevent pivoting of the plug from the second orientation to the first orientation.

18. An electrical connector in accordance with claim 17, wherein the means for guiding the plug comprise the base section having a guide groove formed therein, and wherein the plug has a rib depending therefrom, the rib being sized and shaped to be received in the guide groove and be slidably guided along the guide groove when the plug is inserted into the base section.

19. An electrical connector in accordance with claim 18, wherein the means for pivoting the plug comprise the base section having a hole formed in a side wall of the base section, the hole communicating with an end of the guide groove so that upon insertion of the plug into the base section, the rib on the plug exits from the end of the guide groove into the hole, and wherein the rib has a size and shape allowing the rib to be pivoted in the hole when the plug is pivoted relative to the base section from the first orientation to the second orientation, and wherein when the plug is in the second orientation the rib is misaligned with the guide groove preventing withdrawal of the plug from the base section, wherein when the rib is misaligned, the rib provides the first locking means.

* * * * *